US008074663B2

(12) United States Patent
Ning

(10) Patent No.: US 8,074,663 B2
(45) Date of Patent: Dec. 13, 2011

(54) FLAME-RETARDANT AND FIREPROOF CIGARETTE

(75) Inventor: Tian Ning, Beijing (CN)

(73) Assignee: Tian Ning (CN)

( * ) Notice: Subject to any disclaimer, the term of this patent is extended or adjusted under 35 U.S.C. 154(b) by 527 days.

(21) Appl. No.: 12/238,914

(22) Filed: Sep. 26, 2008

(65) Prior Publication Data

US 2009/0320865 A1 Dec. 31, 2009

(30) Foreign Application Priority Data

Jun. 25, 2008 (CN) ..... 2008 1 0115555

(51) Int. Cl.

| | |
|---|---|
| ***A24D 1/02*** | (2006.01) |
| ***D21H 11/00*** | (2006.01) |
| ***D21H 13/00*** | (2006.01) |
| ***D21H 15/00*** | (2006.01) |
| ***D21H 17/00*** | (2006.01) |
| ***D21H 19/00*** | (2006.01) |
| ***D21H 21/00*** | (2006.01) |
| ***D21H 23/00*** | (2006.01) |
| ***D21H 25/00*** | (2006.01) |
| ***D21H 27/00*** | (2006.01) |

(52) U.S. Cl. ..... 131/365; 131/336; 131/331; 131/349; 162/139

(58) Field of Classification Search ..... None
See application file for complete search history.

(56) References Cited

U.S. PATENT DOCUMENTS

| | | | | |
|---|---|---|---|---|
| 2,992,647 | A * | 7/1961 | Figge | 131/336 |
| 3,016,903 | A * | 1/1962 | Touton | 131/361 |
| 4,480,650 | A | 11/1984 | Weinert | |
| 6,929,013 | B2 * | 8/2005 | Ashcraft et al. | 131/365 |

FOREIGN PATENT DOCUMENTS

| | | | |
|---|---|---|---|
| CN | 2237336 | Y | 8/1996 |
| CN | 2481151 | Y | 3/2002 |
| CN | 2682864 | Y | 10/2003 |
| CN | 2634836 | Y | 8/2004 |
| JP | 9-173041 | | 7/1997 |

* cited by examiner

*Primary Examiner* — Richard Crispino
*Assistant Examiner* — Phu Nguyen
(74) *Attorney, Agent, or Firm* — Boyle Fredrickson, S.C.

(57) ABSTRACT

A flame-retardant and fireproof cigarette which aims to contain the combustion process to the cigarette. The flame-retardant and fireproof cigarette has a filter that is aligned with a tobacco body. A flame-retardant and fireproof covering is positioned over at least a portion of the tobacco body and isolates the open fire associated with the consumption of the tobacco during the course of smoking or burning the cigarettes. Such a cigarette reduces the risk of undesired, inadvertent, and latent ignition of adjacent materials.

20 Claims, 4 Drawing Sheets

FLAME-RETARDANT AND FIREPROOF CIGARETTE

CROSS-REFERENCE TO RELATED APPLICATIONS

This application claims priority to Chinese Application 200810115555.5 filed on Jun. 25, 2008, the disclosures of which are expressly incorporated herein.

FIELD OF THE INVENTION

The present invention relates to a kind of cigarette, especially to a kind of self-extinguishing, flame-retardant and fireproof cigarette which can reduce the possibility of fire caused by a burning cigarette end.

BACKGROUND OF THE PRESENT DISCLOSURE

At present, as to fire accidents caused by various reasons, those accidents caused by burning ends of cigarettes that are abandoned at will has increased in frequency hundreds and thousands times than fire accidents caused by other reasons. At least one reason of this fact is that although the governments of various countries work hard to dissuade people from smoking, the number of people who smoke is still very large. Smokers may smoke at any places except non-smoking areas and tend to throw away cigarette ends anywhere at will. Additionally, falling asleep with a lit cigarette can also result in unintended ignition of nearby combustible materials. Such careless disposal or inattention can result in the undesired igniting of the somewhat inflammable substance such as beddings, clothing, paper, trees, and etc. by burning cigarettes ends, so as to cause fire accidents.

Therefore, it is a preferable option for reducing such fire accidents to provide a cigarette or other product that is commonly consumed by combustion/heat which can reduce the potential of unintended ignition of other combustible materials, so as to reduce the number of fire accidents caused by the use of such products.

SUMMARY OF THE PRESENT INVENTION

The present invention provides a kind of flame-retardant and fireproof cigarette intended to reduce the incidents of undesired combustions caused by discarded or inappropriately attended cigarette ends and/or smoking processes.

The present invention aims at overcoming the defect that existing cigarette may result in unintended open fires. Its principle is to arrange a means in a cigarette to isolate open fire of its cigarette end or a means to isolate open fire of a cigarette during the entire course of smoking. Since the present invention can effectively isolate open fire of a burning cigarette or a cigarette end, the risk of fire accidents caused by smoking can be reduced.

The basic structure of the flame-retardant and fireproof cigarette according to one aspect of the invention includes a filter, a bar-shaped cigarette body of tobacco that is connected or end-to-end joined to the filter, and a flame-retardant and fireproof covering that covers or partially covers the bar-shaped cigarette body.

Another aspect of the invention includes a flame-retardant and fireproof cigarette that has a filter core, a tobacco body which is end-to-end joined to the filter core, and a flame-retardant and fireproof covering which wraps a part of the tobacco body and connects to the filter core in a muff coupling way or a sleeve joint way. Preferably, a filter paper casing wraps the filter core being connected to the flame-retardant and fireproof covering. A cigarette paper casing wraps the rest part of the tobacco body and a part of the flame-retardant and fireproof covering.

Another aspect of the invention usable with one or more of the above aspects includes an external casing that wraps the internal core, so that the filter paper casing wraps the filter core, and the flame-retardant and fireproof covering and the cigarette paper casing wrap the tobacco body.

A further aspect of the invention usable with one or more of the above aspects includes providing a number of pieces of flame-retardant and fireproof covering which are mutually separated and wrap the tobacco body. Adjacent coverings are adjoined and are bond by the cigarette paper casing. The flame-retardant and fireproof covering adjacent to the filter core is connected to the filter core in a muff coupling way or sleeve joint way. A filter paper casing which wraps the filter core is connected to the flame-retardant and fireproof covering in a muff coupling way or sleeve joint way.

A further aspect of the invention usable with one or more of the above aspects includes proving a number of pieces of flame-retardant and fireproof covering which are mutually separated and which are joined by a number of cigarette paper casings.

Preferably, in accordance with one or more of the aspects above, the flame-retardant and fireproof covering is in the shape of sleeve and made of flame-retardant materials. Preferably, the covering is divided into a cover area for covering the cigarette end, a ventilated area for ventilating or airing, and a flame-retardant area for stopping or retarding flame. Preferably, a number of perforations, long cuttings, or slits are distributed over the cover area and a number of perforations, short cuttings, or slits are distributed in the ventilated area.

A further aspect of the invention usable with one or more of the aspects above includes providing a tooth-shaped sealing part for binding up the top end of the tobacco body which locates in the front of the tobacco body.

In addition to any of the aspects above, it is a further aspect that the flame-retardant and fireproof covering can be made of aluminum foil, copper foil or gold foil.

In one preferred aspect, the flame-retardant and fireproof covering have been arranged in the back end of the cigarette. When the cigarette burns up to a cigarette end, the cover area of the flame-retardant and fireproof covering binds up the cigarette end so as to isolate the open fire of the cigarette end. Alternatively, the length of the flame-retardant and fireproof covering is equivalent to that of the cigarette body. The open fire of the cigarette body will be isolated from the outside in the entire course of smoking, so as to relative completely avoid the fire accident caused by smoking. Another aspect usable with one or more of the aspects above includes providing the flame-retardant and fireproof coverings as several discriminate pieces, which will diminish gradually with shortening of the cigarette body. Therefore, the flame-retardant and fireproof cigarette according to present invention will basically keep the feature of a cigarette being burned out and shortened little by little.

In accordance with each of the aspects above, it is envisioned that the flame-retardant and fireproof covering directly wrap the tobacco body such that there is no cigarette paper casing between the flame-retardant and fireproof coverings and the tobacco.

It is envisioned that a cigarette constructed in accordance with one or more of these aspects will appreciate the advantages of a reduced rate of unintentional combustions caused by cigarette ends, that cigarettes constructed in accordance with present invention can be manufactured with existing equipment without increasing equipment cost, and that the flame-retardant materials, such as aluminum foil, copper foil or gold foil, can be adopted as substitute for conventional cigarette paper so as to avoid the undesirable smell caused by burning or insufficient burning of cigarette papers.

Further explanation of the invention will be provided with reference to the accompanying drawings.

DETAILED DESCRIPTION

The technical terms relating to the present invention shall be defined before explanation in details. With respect to the figures collectively, the following reference numbers are commonly associated with the structure of the cigarettes as follows: 1—filter; 11—filter core; 12—filter paper casing; 2—flame-retardant and fireproof covering; 21—flame-retardant area; 22—ventilated area; 23—cover area; 24—tooth sealing part; 3—internal core; 4—tobacco body; 5—cigarette body; 51—cigarette paper casing; and 6—external casing. As used herein, a cigarette body is a substance with an internal core of tobacco and an external layer of cigarette paper, wherein the cigarette paper is also called cigarette paper casing. Tobacco body is a block of tobacco mass without a cigarette paper, in other word, a bar shaped substance composed of tobacco. Cigarette is the joint name of the cigarette body and the tobacco body, which can be either an individual cigarette body or an individual tobacco body, or the combination of a cigarette body and a tobacco body, i.e., a combination including the cigarette body and the tobacco body.

Generally, the flame-retardant and fireproof cigarette according to the present invention comprises: a filter 1, a bar-shaped cigarette that is connected to or joins the filter 1 in an end-to-end way, and a flame-retardant and fireproof coverings 2 that integrally or partially covers the bar-shaped cigarette.

The following gives a detail explanation of a first, second and third type of cigarette constructed in a flame-retardant or fireproof manner in accordance with the present invention by making a reference to drawings. As used herein, flame retardant and/or fireproof are used synonymously and refer to the cigarette being constructed so as to resist propagation or combustion of materials adjacent the cigarette as compared to the cigarette itself. Whereas the cigarette can be consumed in the customary manner, the construction of the cigarette resists ignition of combustibles that may be adjacent thereto.

Figure 1:
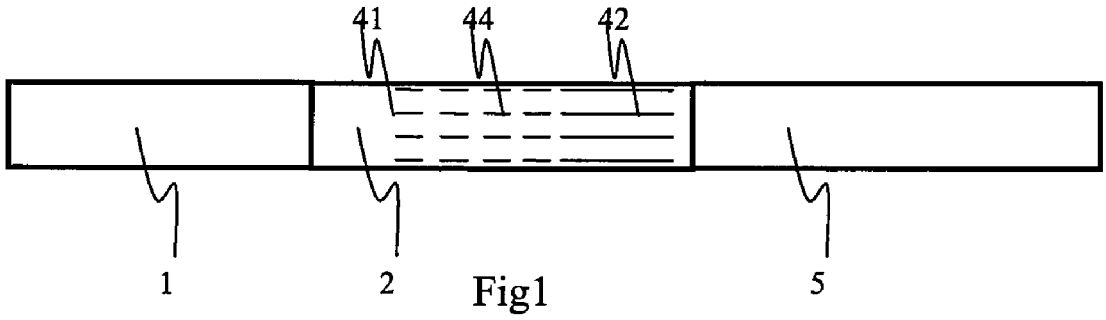
FIG. 1 is a side view of a cigarette according to one embodiment of the present invention.
Figure 2A:
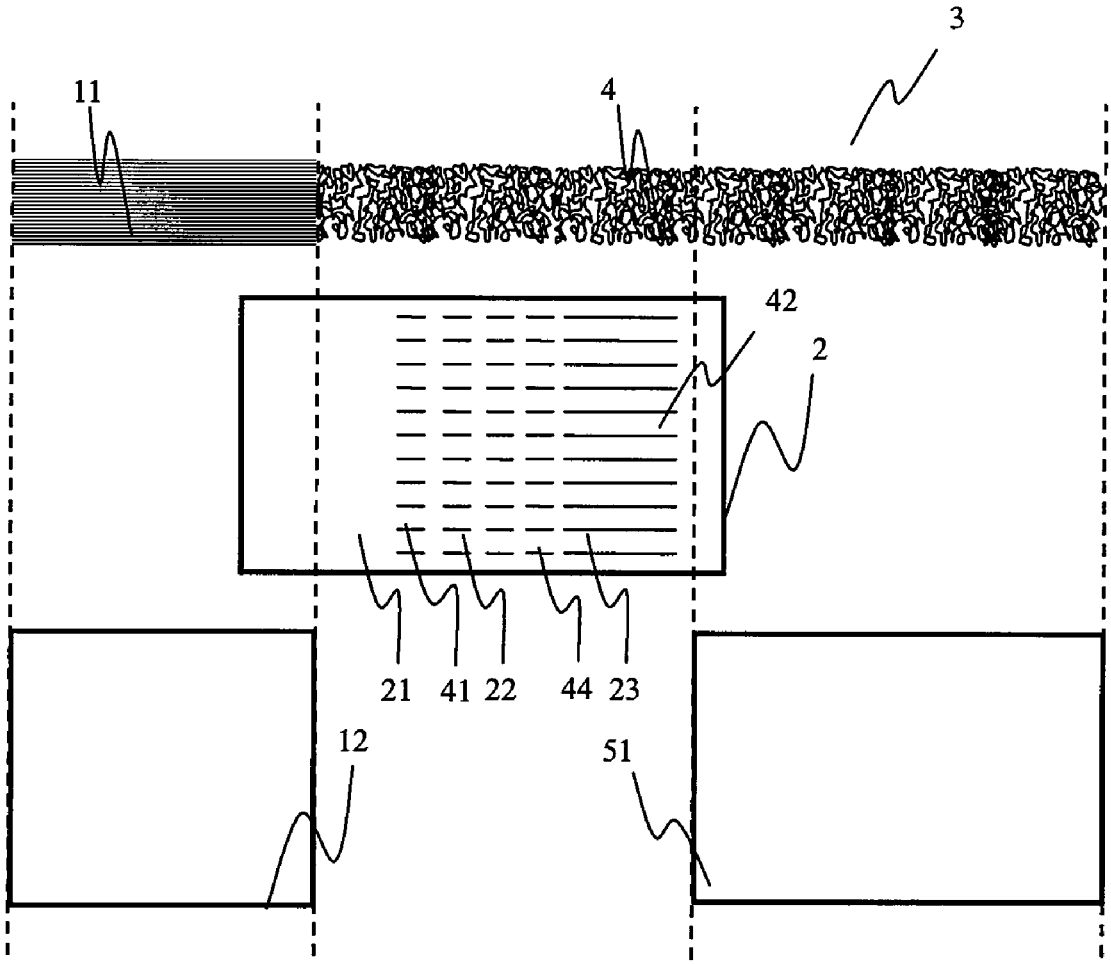
FIG. 2A is an exploded view of the cigarette shown in FIG. 1.
Figure 2B:
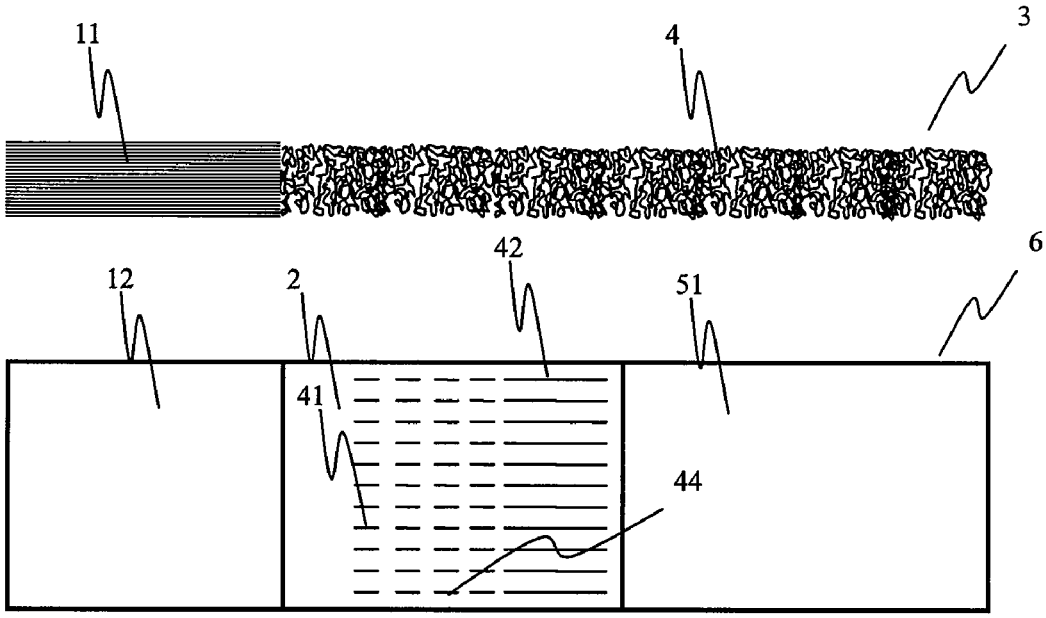
FIG. 2B is an exploded view of a cigarette generally similar to that shown in FIG. 2A but constructed according to another embodiment of the present invention.
Figure 3:
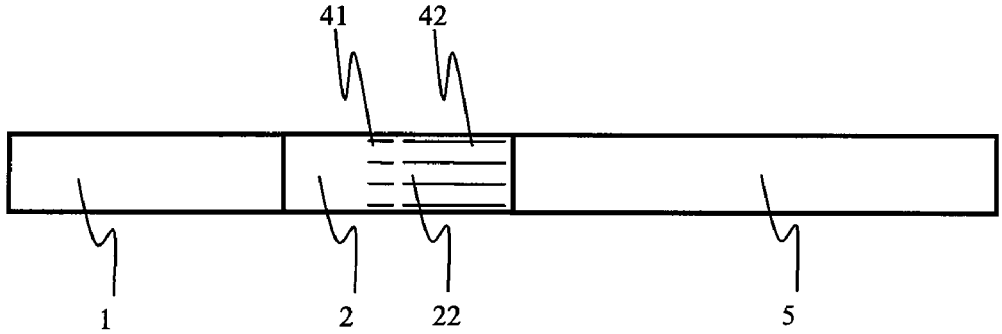
FIG. 3 is a side view of a cigarette according to a further embodiment of the present invention.

Structures of the first type flame-retardant and fireproof cigarette according to the present invention are shown in FIGS. 1-3, respectively. As shown in FIG. 1, the first type flame-retardant and fireproof cigarette comprises a filter 1, a flame-retardant and fireproof covering 2 that adjoins the filter 1 and/or cigarette body 5 that adjoins the flame-retardant and fireproof covering 2.

The first embodiment of the first type flame-retardant and fireproof cigarette according to the present invention is shown in FIG. 2A. As shown therein, the cigarette includes a filter core 11 and a tobacco body 4 which is joined end-to-end to the filter core 11. A flame-retardant and fireproof covering 2 wraps at least one part of the tobacco body 4 and is connected to the filter core 11 in a muff coupling way or in a pipe connection fashion.

A filter paper casing 12 wraps about the filter core 11 and is joined to the flame-retardant and fireproof covering 2. A cigarette paper casing 51 wraps another part of the tobacco body 4 and overlaps a part of the flame-retardant and fireproof covering 2.

Referring now to the second embodiment of a flame-retardant and fireproof cigarette according to the present invention, the cigarette includes an internal core 3 having a filter core 11 and a tobacco body 4 that are aligned with one another in an end-to-end fashion. The cigarette includes an external casing 6 formed of a filter paper casing 12, a flame-retardant and fireproof coverings 2, and a cigarette paper casing 51 that are bonded or stuck together. The external casing 6 wraps the internal core 3 so that the filter paper casing 12 wraps the filter core 11, and the flame-retardant and fireproof covering 2 and the cigarette paper casing 51 wrap the tobacco body 4.

FIG. 3 shows another embodiment of the invention that is generally similar to the embodiments shown in FIGS. 1, 2A, and 2B. With respect to the embodiment shown in FIG. 3, the flame-retardant and fireproof covering 2 of the flame-retardant and fireproof cigarette is shorter than the covering 2 of the cigarettes shown in FIGS. 1, 2A, and 2B. Covering 2 of the embodiment of the cigarette shown in FIG. 3 includes only one group of short cuttings are distributed in ventilated area 22 as compared to the several groups of short cuttings distributing in the ventilated area 22 of the cigarettes shown in FIGS. 1, 2A, and 2B.

Flame-retardant and fireproof coverings 2 are arranged in the cigarette to avoid exposure of an open flame so as to prevent inducing incidental, accidental, or unintentional fire accidents. Although the length of the flame-retardant and fireproof coverings 2 is shorter than that of the cigarette body 5, as described further below, flame-retardant and fireproof coverings 2 can extend a greater length of the cigarette and could a length generally equal to that of the cigarette body 5.

Each flame-retardant and fireproof covering 2 is in the shape of a sleeve and is made of flame-retardant or resistant materials such as aluminum foil, copper foil or gold foil. Each of these materials is generally impermeable to air, tobacco 4 would combust in a less than desired manner or prematurely extinguish were covering 2 formed as a generally continuous sheet of such materials. With respect to the embodiment shown in FIG. 1, it is envisioned that covering 2 can be roughly divided into a cover area 23 for covering nearer an ignition end of the cigarette, a ventilated area 22 for ventilating or airing, and a flame-retardant area 21 for stop burning or inflammation. The cover area 23, the ventilated area 22, and the flame-retardant area 21 wrap a part of the tobacco body 4 directly, wherein the flame-retardant area 21 connects to the filter core 11 in a muff coupling or in a sleeve joint way. The filter paper casing 12 of the filter 1 covers the filter core 11 and a part of the flame-retardant area 21, and the cigarette paper casing 51 of the cigarette body 5 covers the remaining part of the tobacco body 4 and a part of the cover area 23. Of course, the flame-retardant and fireproof covering 2 may also be bonded or stuck directly onto the cigarette body 5 and the filter 1.

Figure 4A:
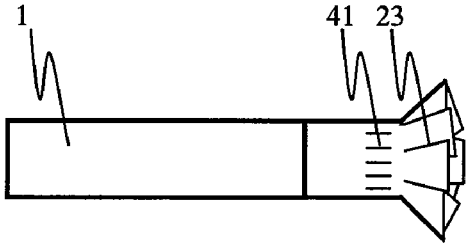
FIG. 4A is a side view of a portion of any of the cigarettes shown in FIGS. 1-3 and shows a crushable cover area thereof.
Figure 4B:
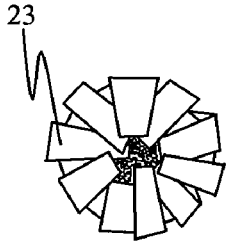
FIG. 4B is an end view of the cover area of the cigarette shown in FIG. 3.

There are a number of perforations 41, such as long cuttings or slits 42 distributing in the cover area 23 so that any of the cigarettes shown in accompanying drawings can attain an end shape similar to that shown in FIGS. 4A and 4B when the cigarette is crushed or stubbed out. Perforations 41 allow the expansion of cover 2 such that the open fire of the cigarette end will be in near complete isolation to areas outside cover 2 or atmosphere. The cuttings or slits 42 are in the shape of elongated slots that do not extend to the end of the cover area 23.

A number of short ventilating slits 44 are distributed in the ventilated area 22 so as to promote burning of the cigarette body 5 and to diffuse or dissipate some heat energy to limit the temperature in the cigarette body 5.

The flame-retardant area 21 of cover 2 adjoins the ventilated area 22 and is located near the filter 11. Since, under most circumstances, this is the position of the burning tobacco when most smokers discard a cigarette; this is the most applicable location to form the cigarette end as shown in FIGS. 4A and 4B wherein the flame-retardant area 21 can be completely separated from open fire of the cigarette end. In fact, slits in the cover area 23 and the ventilated area 22 are quite tiny and are sufficiently sized to isolate open fire of the cigarette body 5. However, theoretically, the separation function of open fire in cover area 23 is not as complete or thorough as that of the flame-retardant area 21.

The multiple ventilating slits 44 distributing in the ventilated area 22 are in the shape of a bar or a strip, the length of which is shorter than that of the cuttings or slits 42 in the cover area 23. These ventilating slits may also be arranged in array.

Figure 5A:
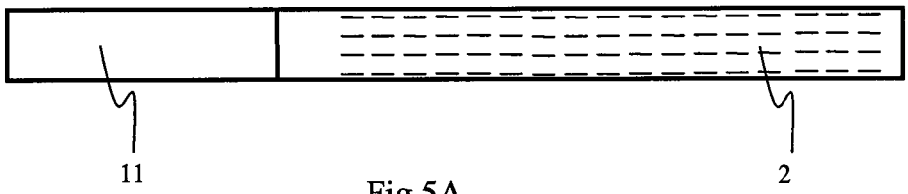
FIG. 5A is a side view of a cigarette according to yet another embodiment of the invention.
Figure 5B:
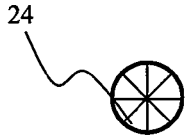
FIG. 5B is an elevational view of an ignition end of the cigarette shown in FIG. 5A.
Figure 6:
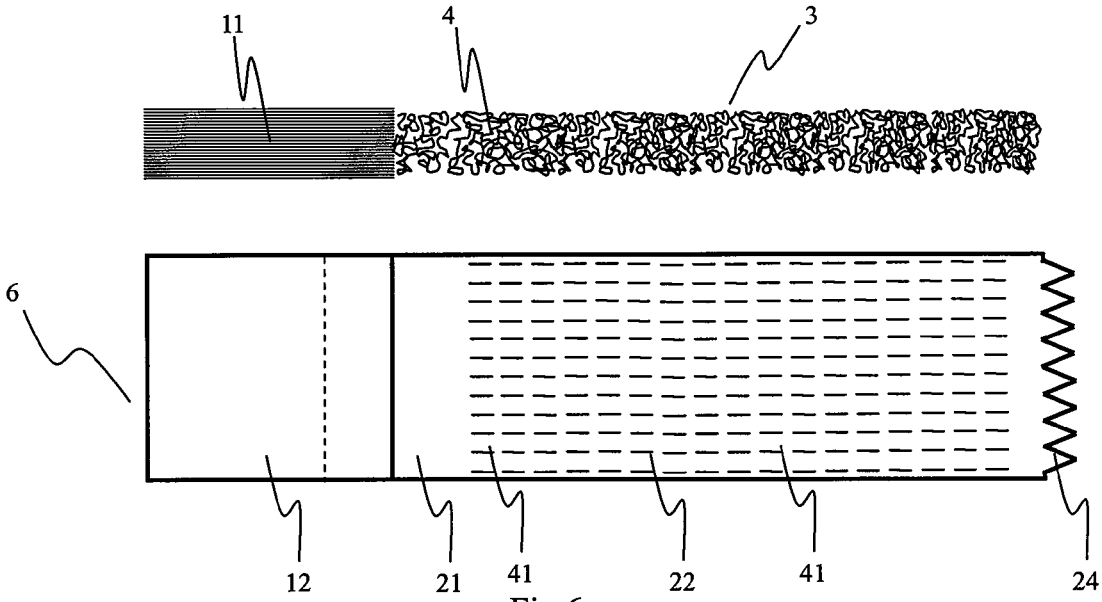
FIG. 6 is an exploded view of the cigarette shown in FIG. 5A.

FIGS. 5A-6 show another flame-retardant and fireproof cigarette according to the present invention. A substantial difference of the cigarette shown in FIGS. 5A-6 as compared to those previously discussed is that flame-retardant and fireproof covering 2 extends near the entire length of the tobacco so as to cover the entire tobacco body 4. It is envisioned that this second type of flame-retardant and fireproof cigarette can be carried out via at least two distinct embodiments although more are envisioned.

The first embodiment of the second type of flame-retardant and fireproof cigarette includes a filter core 11, a tobacco body 4 which is end-to-end joined to the filter core 11, a flame-retardant and fireproof covering 2 which wraps the entire tobacco body 4 and is cup-joined to the filter core 11, and a filter paper casing 12 which wraps the filter core 11 being cup-jointed to flame-retardant and fireproof coverings 2.

The second embodiment of the second type of flame-retardant and fireproof cigarette includes an internal core 3 which possesses an end-to-end jointed filter core 11 and a tobacco body 4. An external casing 6 possessing a filter paper casing 12 and a flame-retardant and fireproof covering 2 that are bonded to each other wraps the internal core 3, so that the filter paper casing 12 wraps the filter core 11, and the flame-retardant and fireproof covering 2 wraps the tobacco body 4.

In the second embodiment of the second type flame-retardant and fireproof cigarette, because the external casing 6 can directly wrap the internal core 3, the manufacturing process of the flame-retardant and fireproof cigarette is greatly simplified as compared to those embodiments previously discussed.

In the second type of flame-retardant and fireproof cigarette, as shown in FIG. 5B, there is a tooth sealing part 24 in the flame-retardant and fireproof coverings 2 in the front of the tobacco body 4 to close up or bind up the top end of the tobacco body. As shown in FIG. 6, the tooth sealing part 24 is located near the front end of the flame-retardant and fireproof covering 2. In the course of manufacture, pressure is applied about the sealing part 24 so that the tooth opening of the flame-retardant and fireproof coverings 2 closes up or binds up the tobacco body 4 therebehind. The flame-retardant and fireproof coverings 2 completely close up the tobacco body 4 so as to further improve the flame-retardant and fireproof effect of the cigarette.

The flame-retardant and fireproof covering 2 of the second type of flame-retardant and fireproof cigarette is in the shape of sleeve and is made of flame-retardant materials similar to the cover discussed above. It is divided in order into the ventilated area 22 for ventilating, and flame-retardant area 21 for stopping or retarding the flame or combustion associated with the consumption of the cigarette. The ventilated area 22 includes a number of short cuttings or slits 41 that are distributed throughout the ventilated area 22.

Since the flame-retardant and fireproof covering 2 covers the entire tobacco body 4, it is a kind of cigarette which is absolutely flame-retardant and fireproof. That is, any flame associated with the combustion of tobacco 4 is enclosed such that no open fire is exposed when tobacco is burning in the flame-retardant and fireproof covering 2. In this way, commonly inflammable materials such as bedding, clothing, furniture, furniture coverings, or the like, can not be ignited even if the inflammable object is put in close or touching proximity relative to a burning cigarette.

Figure 7:
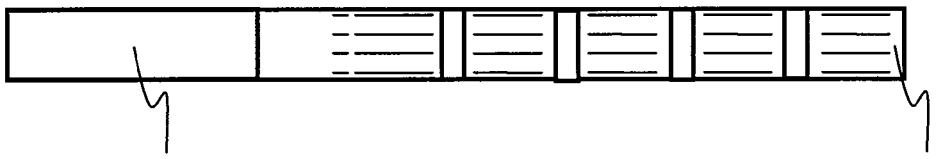
FIG. 7 is a side view of a cigarette according to a further embodiment of the invention.
Figure 8:
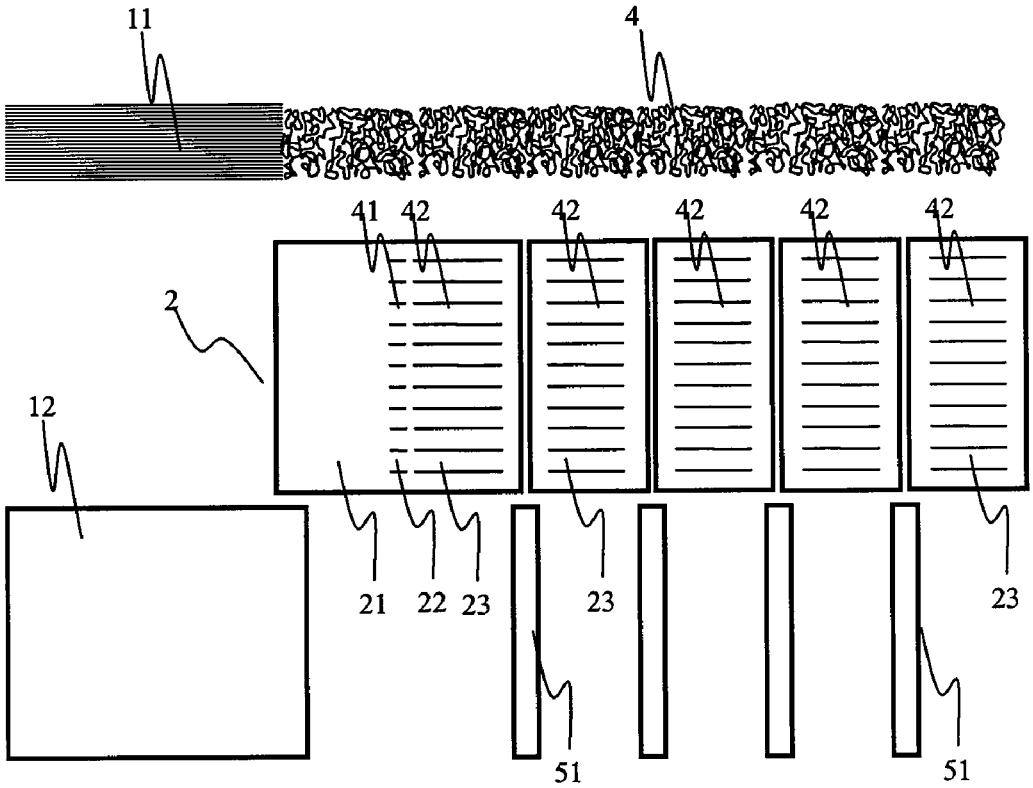
FIG. 8 is an exploded view of the cigarette shown in FIG. 7.
Figure 9:
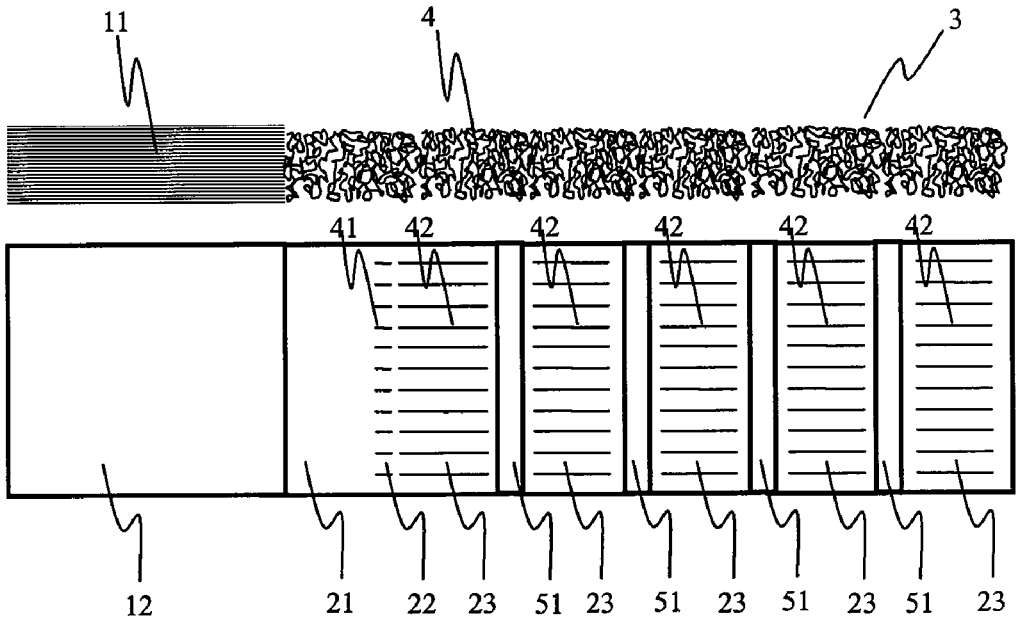
FIG. 9 is an exploded view of a cigarette according to another embodiment of the invention.

FIGS. 7-9 show a third type of flame-retardant and fireproof cigarette according to another embodiment of the invention. As shown in FIGS. 7 to 9, tobacco body 4 is wrapped by a number of pieces of flame-retardant and fireproof covering 2 that are mutually isolated. The total length of the cigarette will gradually shorten little by little as the tobacco is consumed during combustion. As described below, it is envisioned that the third type of flame-retardant and fireproof cigarette according to the present invention can also be realized in at least two different embodiments.

As shown in FIG. 8, the first embodiment of a cigarette constructed in accordance with the third type flame-retardant and fireproof cigarette embodiment includes a filter core 11, a tobacco body 4 which is end-to-end joined to the filter core 11, and a number of pieces of mutually separated flame-retardant and fireproof covering 2. The covering 2 cooperates to wrap the tobacco body 4. Adjacent flame-retardant and fireproof covering 2 is mutually separated and is cup-joined by cigarette paper casing 51. The flame-retardant and fireproof covering adjacent to the filter core 11 is cup-joined to the filter core 11. The filter paper casing 12 that wraps the filter core 11 is cup-jointed to the nearest flame-retardant and fireproof covering 2.

As shown in FIG. 9, a cigarette constructed according to a second embodiment of the third type of flame-retardant and fireproof cigarette includes an internal core 3 which possesses a filter core 11 and a tobacco body 4 which are end-to-end jointed. An external casing 6 is positioned about the internal core 3 and includes a filter paper casing 12, a number of pieces of flame-retardant and fireproof covering 2 that are mutually separated, and a number of cigarette paper casings 51 disposed between adjacent covering 2. The filter paper casing 12 is bonded or stuck to the piece of flame-retardant and fireproof covering 2 that is adjacent to it. A number of pieces of flame-retardant and fireproof covering 2 are bound together by means of a number of cigarette paper casings 51. The external casing 6 wraps the internal core 3 of the cigarette, so that the filter paper casing 12 wraps the filter core 11, and the flame-retardant and fireproof covering 2 which is bonded or stuck together by means of the cigarette paper casings 51 wrap the tobacco body 4.

Pieces of flame-retardant and fireproof covering 2 of the third type of flame-retardant and fireproof cigarette are in the shape of sleeves and are made of the non-combustible or flame-retardant materials. The flame-retardant and fireproof covering 2 adjacent to the filter core 11 is divided into a cover area 23 for covering the cigarette end, a ventilated area 22 for ventilating and airing the tobacco, and a flame-retardant area 21 for stopping or retarding flame. However, there is only a cover area 23 in other pieces of flame-retardant and fireproof coverings 2.

Wherein, there are a number of long cuttings or slits distributing in the cover area 23, and there are a number of short cuttings or slits distributing in the ventilated area 22.

One important advantage of the present invention lies in that the flame-retardant and fireproof covering 2 wraps the tobacco body 4 directly rather than wraps the tobacco body 4 via cigarette paper casing. Such a construction avoids or mitigates the peculiar smell associated with the burning or non-sufficient burning of the cigarette paper casing in the flame-retardant and fireproof covering 2.

Although the present invention is explained in details hereinabove, the present invention is not limited to the above description. The person skilled in the art may make various amendments or modifications to the present invention without departing from the principle of the present invention. Consequently, any amendment or modification in the principle of this invention shall be understood to be covered by the scope of protection afforded the following claims.

What is claimed is:

1. A flame-retardant and fireproof cigarette, comprising:

an internal core having a filter core and a tobacco body which are aligned in an end to end orientation;

an external casing wrapping the internal core, which includes a filter paper casing, a flame-retardant and fireproof covering and a cigarette paper casing; wherein the filter paper casing wraps the filter core, and the flame-retardant and fireproof covering and the cigarette paper casing individually wrap the tobacco body;

the flame-retardant and fireproof covering is arranged between the filter paper casing and the cigarette paper casing, so as to prevent the tobacco body in the state of burning from being exposed to the outside when the tobacco body burns and reduces its length to be inside of flame-retardant and fireproof covering; and the flame-retardant and fireproof covering is made of incombustible materials and is equipped with a ventilated area for stimulating static burning.

2. The flame-retardant and fireproof cigarette according to claim 1, wherein the filter paper casing, the flame-retardant and fireproof covering and the cigarette paper casing are bonded together.

3. The flame-retardant and fireproof cigarette according to claim 2, wherein a part of the flame-retardant and fireproof covering connects to the filter core in one of a muff coupling way or pipe connection way.

4. The flame-retardant and fireproof cigarette according to claim 2, wherein the filter paper casing and the cigarette paper casing are separately bonded to generally opposite ends of the flame-retardant and fireproof covering.

5. The flame-retardant and fireproof cigarette according to claim 1, wherein the flame-retardant and fireproof covering is equipped with a cover area for covering a cigarette end and an flame-retardant area for stopping burning of the tobacco body respectively at opposite ends of the ventilated area.

6. The flame-retardant and fireproof cigarette according to the claim 5, further comprising a number of cuts formed through the each of the cover area and the ventilated area and wherein the cuts formed through the cover area are longer than the cuts formed through the ventilated area.

7. A flame-retardant and fireproof cigarette, comprising:

an internal core having a filter core and a tobacco body which are end to end joined to each other;

an external casing wrapping the internal core and which includes a filter paper casing and a flame-retardant and fireproof covering, wherein the filter paper casing wraps the filter core, and the flame-retardant and fire proof covering individually wraps the tobacco body;

the tobacco body is fully wrapped by the flame-retardant and fireproof covering, so as to prevent the tobacco body in the state of burning from being exposed to the outside during the course of smoking; and the flame-retardant and fireproof covering is made of incombustible materials and is equipped with a ventilated area for stimulating static burning.

8. The flame-retardant and fireproof cigarette according to claim 7, wherein the filter paper casing and the flame-retardant and fireproof covering are bonded to each other.

9. The flame-retardant and fireproof cigarette according to claim 8, wherein a part of the flame-retardant and fireproof covering connects to the filter core in a muff coupling way.

10. The flame-retardant and fireproof cigarette according to claim 9, wherein the filter paper casing is bonded to a periphery of one end of the flame-retardant and fireproof covering.

11. The flame-retardant and fireproof cigarette according to claim 10, wherein the flame-retardant and fireproof covering and is equipped with a cover area for covering a cigarette end and an flame-retardant area for stopping burning respectively at opposite ends of the ventilated area.

12. The flame-retardant and fireproof cigarette according to claim 11, wherein a number of longer cuttings are distribute in the cover area and are longer than a number of shorter cuttings that are distribute in the ventilated area.

13. The flame-retardant and fireproof cigarette according to claim 12, wherein the flame-retardant and fireproof covering has a tooth-shaped sealing part locating at an end of the tobacco body to envelope the end of the tobacco body.

14. A flame-retardant and fireproof cigarette, comprising:

an internal core formed by a filter core and a tobacco body which are end to end joined to each other;

an external casing wrapping the internal core, the external casing including a filter paper casing, multiple sections of flame-retardant and fireproof covering that are mutually separated, and a number of cigarette paper casings that are located between adjacent sections of the flame-retardant and fireproof covering; wherein the filter paper casing wraps the filter core, and the multiple sections of flame-retardant and fire proof covering and the cigarette paper casings cooperate to individually wrap the tobacco body;

the multiple sections of flame-retardant and fireproof covering are made of incombustible materials, and an end section of the multiple sections of flame-retardant and fireproof covering adjacent to the filter core is equipped with a ventilated area for stimulating static burning; and the sections of flame-retardant and fireproof covering are bonded together by means of the cigarette paper casings so that the sections of flame-retardant and fireproof covering fall off one by one with in-order burnout of the cigarette paper casings.

15. The flame-retardant and fireproof cigarette according to claim 14, wherein the filter paper casing is bonded to the end of respective adjacent sections of flame-retardant and fire proof covering.

16. The flame-retardant and fireproof cigarette according to claim 15, wherein the end section of the multiple sections of flame-retardant and fireproof covering adjacent to the filter core is equipped with a cover area for covering a cigarette end and flame-retardant area for stopping burning, and the other sections of multiple sections of flame-retardant and fireproof covering have only a cover area.

17. The flame-retardant and fireproof cigarette according to claim 16, wherein a number of longer perforations are distributed over the cover area, and a number of shorter perforations are distributed over the ventilated area.

18. The flame-retardant and fireproof cigarette according to claim 17, wherein the flame-retardant and fireproof covering has a tooth-shaped sealing part that is located at an end of the tobacco body to envelope the end of the tobacco body.

19. The flame-retardant and fireproof cigarette according to claim 15, wherein a part of the flame-retardant and fireproof covering connects to the filter core in a muff coupling way.

20. The flame-retardant and fireproof cigarette according to claim 19, wherein the filter paper casing is bonded to a periphery of one end of the flame-retardant and fireproof covering.

* * * * *